US007296661B1

(12) United States Patent
Petricio Yaksic

(10) Patent No.: US 7,296,661 B1
(45) Date of Patent: Nov. 20, 2007

(54) ELEVATOR LEVELLING

(76) Inventor: Davor Petricio Yaksic, La Colpa 681, Sector la Chimba, Casilla 902, Antofagasta (CL)

( * ) Notice: Subject to any disclaimer, the term of this patent is extended or adjusted under 35 U.S.C. 154(b) by 0 days.

(21) Appl. No.: 11/165,228

(22) Filed: Jun. 24, 2005

(51) Int. Cl.
*B66B 11/08* (2006.01)

(52) U.S. Cl. ..... 187/266; 187/256

(58) Field of Classification Search ..... 187/256, 187/266

See application file for complete search history.

(56) References Cited

U.S. PATENT DOCUMENTS 610,256 A * 9/1898 Brown ..... 187/350
2,861,449 A * 11/1958 Cohan ..... 73/12.01
2,891,636 A * 6/1959 Krieger et al. ..... 187/253
5,018,925 A * 5/1991 Ganser ..... 414/240
5,119,906 A * 6/1992 Kondratuk ..... 187/253
5,533,595 A * 7/1996 Narumi et al. ..... 187/266
6,193,016 B1 * 2/2001 Hollowell et al. ..... 187/250
6,345,695 B1 * 2/2002 Fargo et al. ..... 187/277
6,742,628 B2 * 6/2004 Bauer ..... 187/254

* cited by examiner

*Primary Examiner*—Peter M. Cuomo
*Assistant Examiner*—Eric E. Pico
(74) *Attorney, Agent, or Firm*—James Creighton Wray; Clifford D. Hyra

(57) ABSTRACT

Elevators are maintained in level condition by four fixed ropes or cables passing diagonally across an elevator in angularly related opposite directions. The ropes extend from opposite corners of the elevator to fixed upper and lower ends. Moving the elevator causes equal and opposite changes in lengths of the portions of the ropes extending upward and downward from the pulleys on the elevator, keeping the elevator level.

10 Claims, 4 Drawing Sheets

ELEVATOR LEVELLING

BACKGROUND OF THE INVENTION

Elevators are raised and lowered in guideways using cables which are called ropes. Rollers on the elevators move along the guideways, keeping the elevators centered.

Uneven loads in elevators tend to tip the elevators. Undesirable tipping is controlled by simple or complex mechanisms. Occasionally when riding an unevenly loaded elevator a passenger is aware of sounds related to roller and guideway contact, particularly when starting. The problem of controlling tipping is particularly acute with large room-sized elevators.

Needs exist to maintain elevators level with simple and easy-to-install equipment.

SUMMARY OF THE INVENTION

Elevators are maintained in level condition by four fixed ropes or cables passing diagonally across an elevator in angularly related opposite directions. The ropes extend from opposite corners of the elevator to fixed upper and lower ends. Moving the elevator causes equal and opposite changes in lengths of the portions of the ropes extending upward and downward from the pulleys on the elevator, keeping the elevator level.

A preferred elevator levelling apparatus includes first and second rigidly connected cross beams extending at angles across an elevator. Eight pulleys on the beams include four pulleys on each beam. Paired pulleys are positioned on axles at opposite ends of each beam for freely rotating on the axles. four fixed ropes extend oppositely across the beams and upward and downward from opposite ends of the beams. Each beam has two oppositely extending ropes. Each rope extends downward from a fixed position near a top of an elevator guide around a first pulley, across the beam, around a second pulley and downward to a fixed position near a bottom of the elevator. Raising and lowering an elevator with the crossed beams, pulleys and ropes constrains the ends of the beams and the elevator for equal movement along the ropes and maintains the beams and elevator in constant relation with respect to horizontal.

A preferred elevator levelling apparatus uses an elevator having a rectangular planform. Pairs of pulleys are mounted near corners of the elevator. Ropes have upper ends fixed above the corners near an upper end of a guide and have lower ends fixed below diagonally opposite corners near a bottom of the guide. Each rope extends downward from its fixed upper end, passes around a pulley in one pair, extends diagonally across the elevator, passes around a pulley near a diagonally opposite corner of the elevator, and extends downward to its fixed lower end. Pairs of the ropes extend diagonally in opposite directions across the elevator.

Preferably four ropes are used. Each of the four ropes is connected above a different corner of the elevator and extends downward and corner to corner across the elevator and around the pulleys and downward to its fixed position under a diagonally opposite corner of the bottom of the elevator.

Stabilizing elevators for level operation fixes upper ends of ropes to diagonally opposite spaced positions above corners of an elevator. The ropes extend downward, and pass under and over pulleys at diagonally opposite corners of the elevator. Lower ends of the ropes are fixed to diagonally opposite and spaced anchor positions.

In one embodiment a vertical guideway has a rectangular cross-section, and each rope is connected to the anchor positions and to diagonally opposite upper frame positions.

Preferably an elevator has a rectangular planform. Four ropes extend downward to four corners of the elevator, across the elevator and to diagonally opposite anchors.

Eight pulleys and provided, two at each corner of the rectangular planform elevator.

Brakes connected to the elevator and to the ropes or the pulleys retard or stop the elevator.

Preferably the brakes are regenerative electric brakes.

In some embodiments, motors connected to the pulleys move the elevator.

Preferably, rigidly connected rigid cross-beams are connected across the elevator and extend from corner to corner of the elevator, and the pulleys are mounted in pairs at ends of the rigid cross beams.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
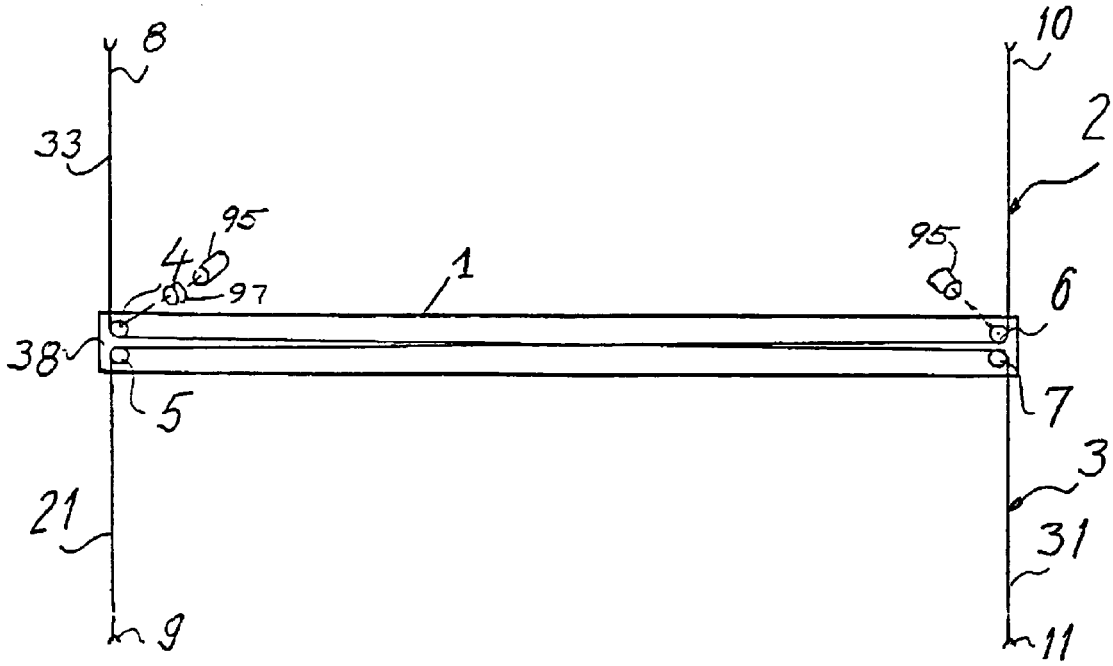
FIG. 1 is a schematic detail of a beam with four pulleys and two fixed ropes which constrain the beam to level up and down movements.

FIG. 1 is a schematic detail of a beam with four pulleys and two fixed ropes which constrain the beam to level up and down movements.

FIG. 1 shows a beam 1 and two ropes 2 and 3 extending around pulleys 5, 6 and 4, 7 respectively on the beam. The rope extremities are held fixed.

Ropes 2 and 3 are fixed at opposite ends 9, 10 and 8, 11 respectively.

The ropes and pulleys ensure that as beam 1 is raised or lowered, both ends of the beam must move equally. For example, moving the beam upward lengthens the portion 21 of rope 2 between fixed end 9 and pulley 5, and shortens portion 33 of rope 3 between fixed end 8 and pulley 43. Concurrently the lengthening of portion 21 shortens portion 23 of rope 2 between pulley 6 and fixed end 10. At the same time, and by the same amount, portion 31 of rope 3 between pulley 7 and fixed end 11 is lengthened. All lengthenings and all shortenings of portions of the ropes are equal. The portions have equal changes or deltas, although changes to the upper portions 33, 23 have opposite signs or directions than the equal but opposite changes to the lower portions 21, 31. The beam 1 is rigid.

Regenerative electric brakes 95 connected to the elevator and to the pulleys 4 and 6 retard or stop the elevator.

Figure 2:
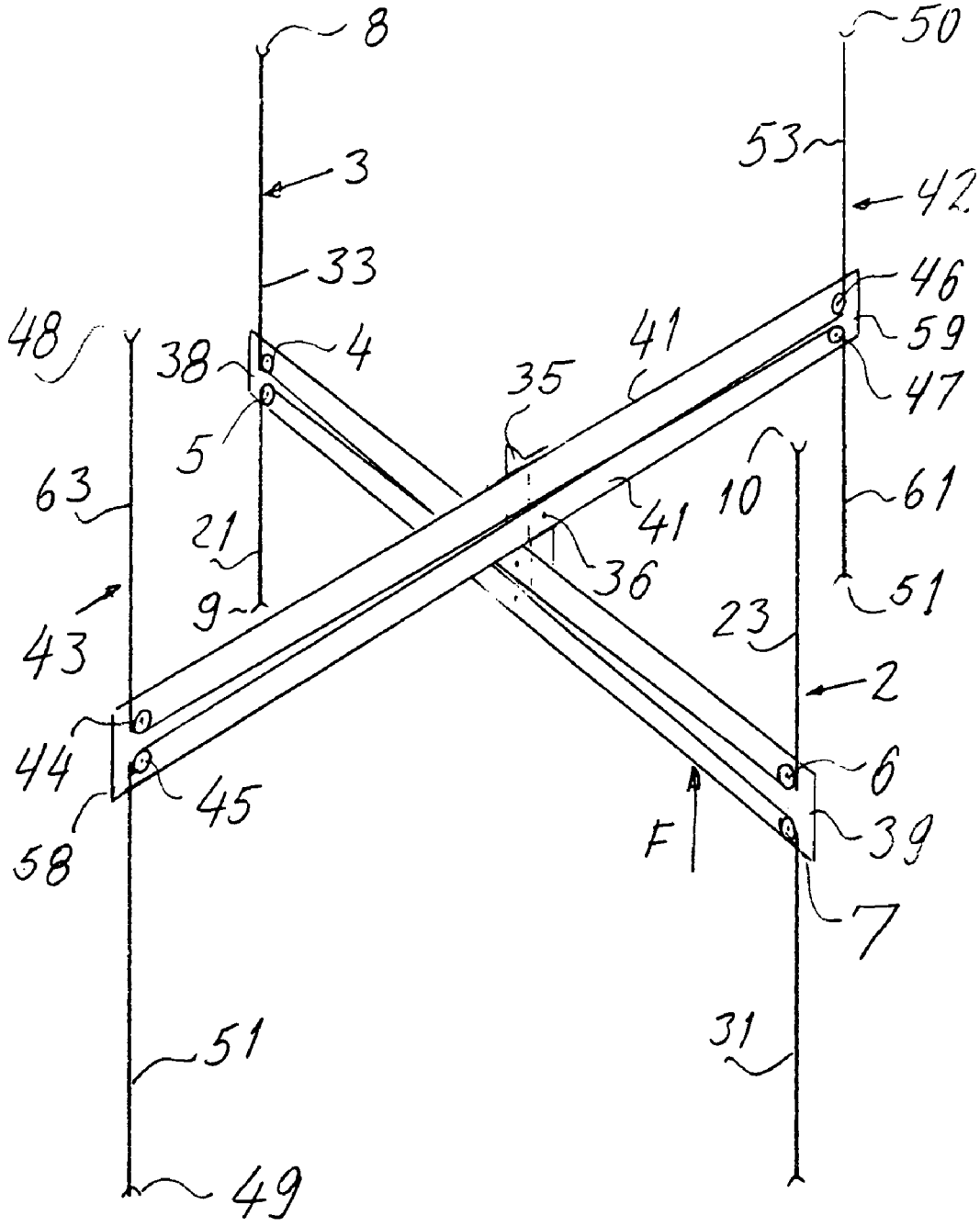
FIG. 2 is a schematic detail of four fixed ropes and two rigidly interconnected crossed rigid beams for attaching to an elevator and constraining the elevator to level raisings and lowerings.

In FIG. 2 a second rigid beam 41 is diagonally rigidly attached to the first beam 1 by a rigid interconnection 35 and bolts 36.

Pulleys 44 and 45 at end 58 of beam 41 are similar to and function similarly to pulleys 4 and 5 at end 38 of beam 1.

Pulleys 46 and 47 at end 59 of beam 41 are similar to and function similarly to pulleys 6 and 7 at end 39 of beam 1.

Ropes 42 and 43 which pass around the pulleys on beams 41 are similar to and function similarly to ropes 2 and 3 which pass around the pulleys on beam 1. Rope 42 is fixed at its upper end 50, descends and passes around pulley 46, extends across beam 41, passes around pulley 45, descends and is anchored and fixed at end 49.

When the cross beams 41 and 1 are connected to an elevator, the elevator may be raised and lowered by cables attached to the central rigid interconnection 35.

Rope 43 is fixed at upper end 48 and passes around pulley 44, across beam 41, and around pulley 47. End 51 is anchored.

Moving any part of the rigidly connected frame upward or downward causes the frame to move in a level condition.

Figure 3:
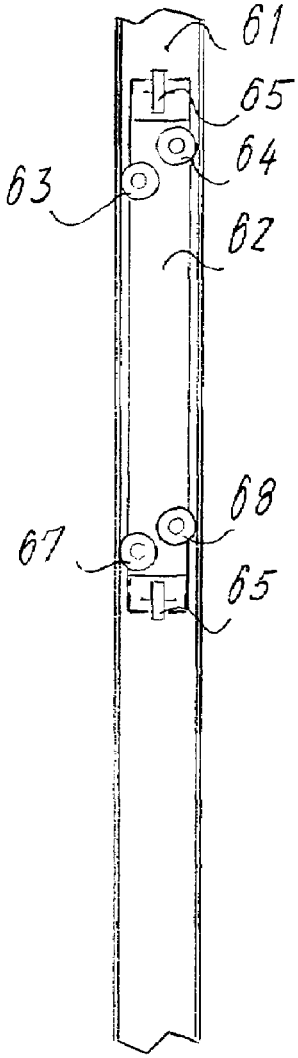
FIG. 3 shows a prior art roller construction for rolling along a fixed channel or I-beam and resisting tipping of an elevator.

FIG. 3 shows a prior art roller construction for rolling along a fixed channel or I-beam and resisting tipping of an elevator.

FIG. 3 shows a prior art elevator guide system that uses two or more guide channels 61 or I-beams to guide rollers 63, 64, 67, 68, which rotate on a mount 62 on connectors 65 extending outward from an elevator.

Figure 4:
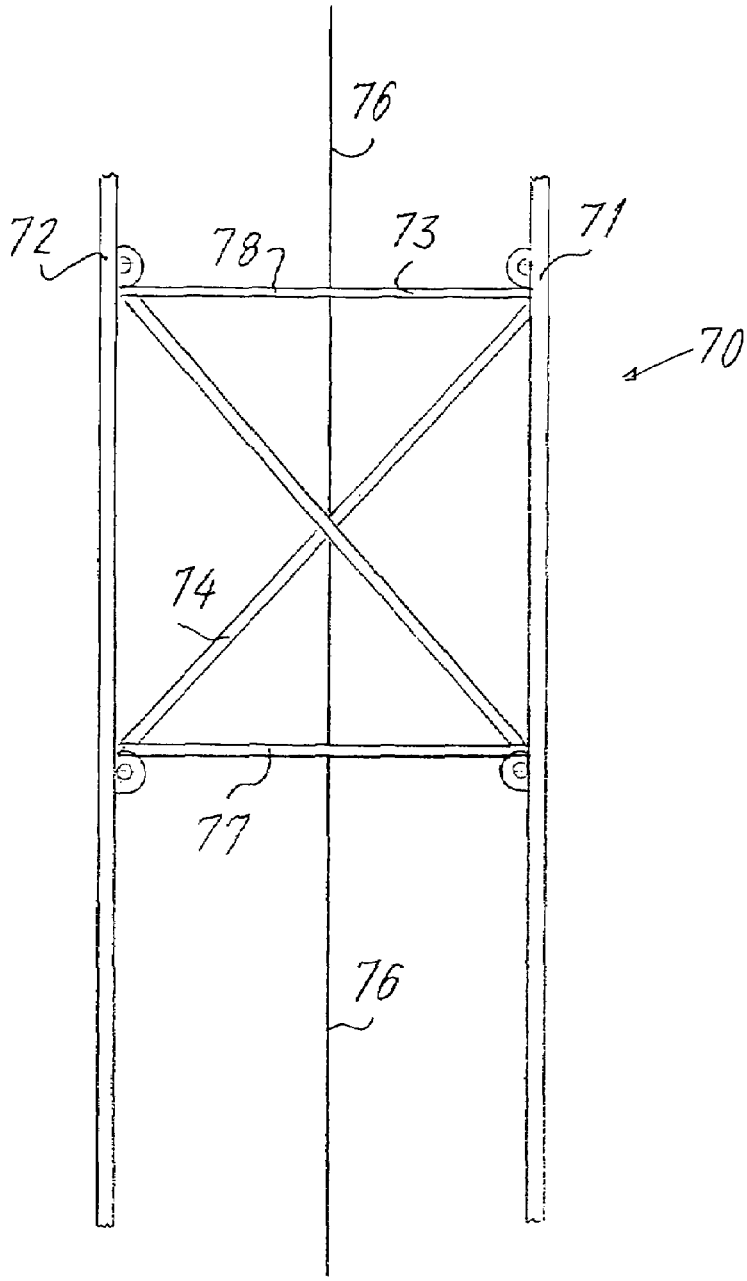
FIG. 4 is a schematic detail of an elevator moving in a guideway.

FIG. 4 is a schematic detail of an elevator moving in a guideway.

FIG. 4 schematically shows a guideway 70 with beams 71, 72 in which elevator 73 rides when hauled upward or lowered by cables 76. The elevator is rigidified with rigid cross beams 74 between the floor 77 and ceiling 78.

Figure 5:
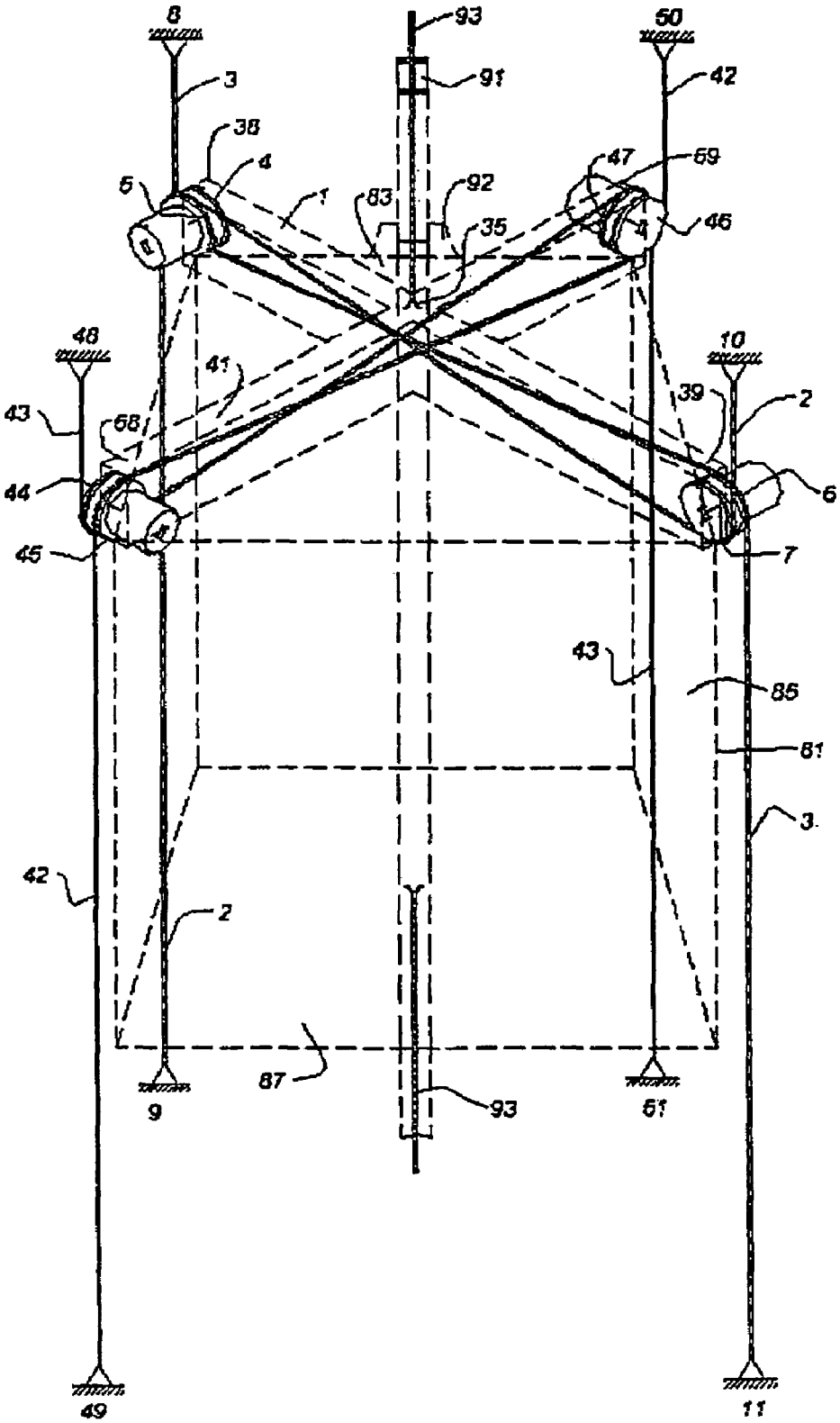
FIG. 5 is a schematic detail of one embodiment of the invention showing a guide I-beam and a guide attached to an elevator with four fixed ropes passing diagonally across the elevator around pulleys at diagonal and spaced positions on the elevator.

FIG. 5 is a schematic detail of one embodiment of the invention showing a guide I-beam and a guide attached to an elevator with four fixed ropes passing diagonally across the elevator around pulleys at diagonal and spaced positions on the elevator.

FIG. 5 shows an elevator 81 guided by a vertical I-beam guide 91 and a guide follower 92. The elevator has a rigid upper frame forming a rectangular ceiling 83, side walls 85 and floor 87. Paired pulleys are mounted near upper corners of the rigid elevator box or roof or on crossed beams in, under or on the roof. The function of the ropes and pulleys is similar to that described with respect to FIG. 2. The elevator roof or base has fixed rigidly interconnected beams 1 and 41.

Pulleys 44 and 45 at end 58 of beam 41 are similar to and function similarly to pulleys 4 and 5 at end 38 of beam 1.

Pulleys 46 and 47 at end 59 of beam 41 are similar to and function similarly to pulleys 6 and 7 at end 39 of beam 1.

Ropes 42 and 43 which pass around the pulleys on beams 41 are similar to and function similarly to ropes 2 and 3 which pass around the pulleys on beam 1. Rope 42 is fixed at its upper end 50, descends and passes around pulley 46, extends across beam 41, passes around pulley 45, descends and is anchored and fixed at end 49.

When the cross beams 41 and 1 are connected to an elevator, the elevator may be raised and lowered by cables attached to the central rigid interconnection 35.

Rope 43 is fixed at upper end 48 and passes around pulley 44, across beam 41, and around pulley 47. End 51 is anchored.

Moving any part of the rigidly connected frame upward or downward causes the frame to move in a level condition.

The elevator is raised or lowered by a series of cables 93 attached centrally to the elevator, or riding in cable guides along sides or corners, if the guideway is formed in a reinforced rectangular cross-section.

The pulleys may be driven by electric motors or brakes regeneratively or mechanically to control elevator movement.

While the invention has been described with reference to specific embodiments, modifications and variations of the invention may be constructed without departing from the scope of the invention, which is defined in the following claims.

I claim:

1. Elevator levelling apparatus, comprising an elevator, first and second rigidly connected cross beams extending at angles across the elevator, eight pulleys on the beams, including four pulleys on each beam, the pulleys further comprising paired pulleys positioned on axles at opposite ends of each beam for freely rotating on the axles, four fixed ropes extending oppositely across the beams upward and downward from opposite ends of the beams, each beam having two oppositely extending ropes, each rope extending downward from a fixed position near a top of an elevator guide around a first pulley, across the beam, around a second pulley and downward to a fixed position near a bottom of the elevator, whereby raising and lowering an elevator with the crossed beams, pulleys and ropes constrains the ends of the beams and the elevator for equal movement along the ropes and maintains the beams and elevator in constant relation with respect to horizontal.

2. Elevator levelling apparatus, comprising an elevator having a rectangular planform, pairs of pulleys mounted near corners of the elevator, an elevator guide, ropes having upper ends fixed above the corners near an upper end of the guide and having lower ends fixedly secured below diagonally opposite corners near a bottom of the guide, each rope extending downward from its fixed upper end, passing around a pulley in one pair, extending diagonally across the elevator, passing around a pulley near a diagonally opposite corner of the elevator, and extending downward to its fixed lower end, pairs of the ropes extending diagonally in opposite directions across the elevator, further comprising a pair of rigidly connected rigid cross beams being connected diagonally across the elevator and extending from corner to corner across the elevator, and wherein the pulleys are mounted in pairs at the ends of the rigid cross beams.

3. The apparatus of claim 2, wherein the ropes comprise four ropes and the guide comprises a rectangular guideway with four corners at the top and the bottom of the guideway, wherein each of the four ropes is connected near a different corner of the top and extends downward, corner to corner across the elevator and around the pulleys and downward to its fixed position near a diagonally opposite corner of the bottom of the guideway.

4. The method of stabilizing elevators for level operation, comprising providing an elevator, fixing upper ends of ropes to diagonally opposite spaced positions above corners of an elevator, extending the ropes downward, passing the ropes under first pulleys at diagonally opposite corners of an elevator, extending the ropes in diagonally opposite spaced directions across the elevator, passing the ropes around second pulleys at diagonally opposite spaced corners of the elevator, extending the ropes downward, and fixedly securing lower ends of the ropes to diagonally opposite and spaced anchor positions, further comprising providing a pair of rigidly connected rigid cross beams being connected diagonally across the elevator and extending from corner to corner across the elevator, and wherein the pulleys are mounted in pairs at the ends of the rigid cross beams.

5. The method of claim 4, further comprising providing a vertical guideway having a rectangular cross-section, and connecting the anchor positions and the upper frame to the guideway.

6. The method of claim 5, wherein the providing the elevator comprises providing an elevator with a rectangular planform, wherein the providing of the ropes further comprises providing four ropes, and wherein the extending the ropes downward comprises extending the ropes downward to four corners of the elevator.

7. The method of claim 6, further comprising providing eight pulleys, two at each corner of the rectangular planform elevator.

8. The method of claim 7, further comprising providing brakes connected to the elevator and to the ropes or the pulleys for retarding or stopping the elevator.

9. The method of claim 8, wherein the brakes are regenerative electric brakes.

10. The method of claim 7, further comprising providing motors connected to the pulleys for moving the elevator.

* * * * *